US009434080B2

(12) United States Patent
Bozikis

(10) Patent No.: US 9,434,080 B2
(45) Date of Patent: Sep. 6, 2016

(54) SHAVING BLADE ASSEMBLY WITH A BLADE UNIT AND A SKIN CONTACT MEMBER

(71) Applicant: Societe BIC, Clichy (FR)

(72) Inventor: Ioannis Bozikis, Koukaki (GR)

(73) Assignee: BIC-VIOLEX SA, Attiki (GR)

( * ) Notice: Subject to any disclaimer, the term of this patent is extended or adjusted under 35 U.S.C. 154(b) by 0 days.

(21) Appl. No.: 13/922,882

(22) Filed: Jun. 20, 2013

(65) Prior Publication Data

US 2014/0373362 A1 Dec. 25, 2014

(51) Int. Cl.
*B26B 21/40* (2006.01)
*B26B 21/44* (2006.01)

(52) U.S. Cl.
CPC ..... *B26B 21/4031* (2013.01); *B26B 21/40* (2013.01); *B26B 21/44* (2013.01)

(58) Field of Classification Search
CPC ..... B26B 21/00–21/10; B26B 21/14; B26B 21/16; B26B 21/22–21/227; B26B 21/30; B26B 21/40; B26B 21/4012–21/4031; B26B 21/44
USPC ..... 30/47–51, 55, 74.1, 77, 41, 41.5, 41.7, 30/41.8
See application file for complete search history.

(56) References Cited

U.S. PATENT DOCUMENTS 5,678,311 A * 10/1997 Avidor ..... 30/50
5,933,960 A * 8/1999 Avidor ..... 30/51
6,185,823 B1 * 2/2001 Brown et al. ..... 30/50
6,212,777 B1 * 4/2001 Gilder et al. ..... 30/50
6,671,961 B1 * 1/2004 Santhagens Van Eibergen et al. ..... 30/50
6,868,610 B2 * 3/2005 Brandt et al. ..... 30/41
6,877,227 B2 * 4/2005 Santhagens Van Eibergen et al. ..... 30/50
6,886,254 B1 * 5/2005 Pennella ..... 30/50
6,889,438 B2 * 5/2005 Brown et al. ..... 30/50
7,103,976 B2 * 9/2006 Pennella ..... 30/50
D547,494 S * 7/2007 Watson et al. ..... D28/47
7,363,715 B2 * 4/2008 Coffin et al. ..... 30/50
7,469,477 B2 * 12/2008 Coffin ..... 30/50
7,574,802 B2 * 8/2009 Pennella ..... 30/50
7,610,683 B2 * 11/2009 Brown et al. ..... 30/50
7,658,009 B2 * 2/2010 Bunnell et al. ..... 30/50
7,703,361 B2 * 4/2010 Johnson et al. ..... 30/77
7,743,506 B2 * 6/2010 Szczepanowski et al. .... 30/41.5
7,802,368 B2 * 9/2010 Coffin et al. ..... 30/50
7,941,931 B2 * 5/2011 Prudden, Jr. ..... 30/539
8,011,101 B2 * 9/2011 Coffin et al. ..... 30/50
8,033,023 B2 * 10/2011 Johnson et al. ..... 30/50
8,037,609 B2 * 10/2011 Nicoll ..... 30/77
8,209,869 B2 * 7/2012 Royle ..... 30/50
8,381,406 B2 * 2/2013 Miyazaki ..... 30/51
8,407,900 B2 * 4/2013 Johnson ..... 30/50

(Continued)

*Primary Examiner* — Jason Daniel Prone
(74) *Attorney, Agent, or Firm* — Polsinelli PC

(57) ABSTRACT

A shaving blade assembly including a blade unit and a skin contact member. A razor including a razor handle and such a shaving blade assembly. The blade unit includes at least one shaving blade having a cutting edge. The blade unit has a blade unit skin contact surface area, where the blade unit and the skin contact member have a shaving blade assembly skin contact surface area. The ratio between the shaving blade assembly skin contact surface area and the blade unit skin contact surface area is between approximately 2 and 3.1. The skin contact member can include a leading planar surface and a trailing planar surface defining a contact plane, and the contact plane and the shaving plane are parallel and the distance between the contact plane and the shaving plane is between approximately 0.2 mm and 0.6 mm.

16 Claims, 7 Drawing Sheets

(56) References Cited

U.S. PATENT DOCUMENTS

| | | | | |
|---|---|---|---|---|
| 2003/0014866 | A1* | 1/2003 | Orloff et al. | 30/50 |
| 2007/0180700 | A9* | 8/2007 | Sandor et al. | 30/50 |
| 2008/0256800 | A1* | 10/2008 | Nicoll | 30/50 |
| 2008/0256801 | A1* | 10/2008 | O'Connor et al. | 30/50 |
| 2008/0256803 | A1* | 10/2008 | Tucker et al. | 30/50 |
| 2011/0126413 | A1* | 6/2011 | Szczepanowski et al. | 30/77 |
| 2012/0000074 | A1* | 1/2012 | PazosSchroeder | 30/34.05 |
| 2012/0151772 | A1* | 6/2012 | Moon et al. | 30/50 |
| 2013/0160296 | A1* | 6/2013 | Park et al. | 30/34.05 |

* cited by examiner

FIG. 12
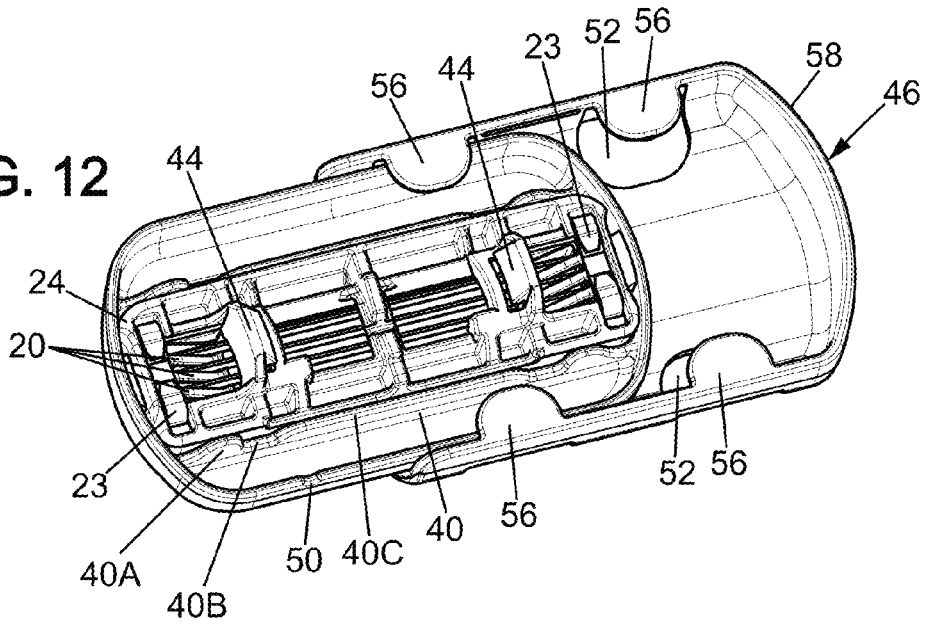
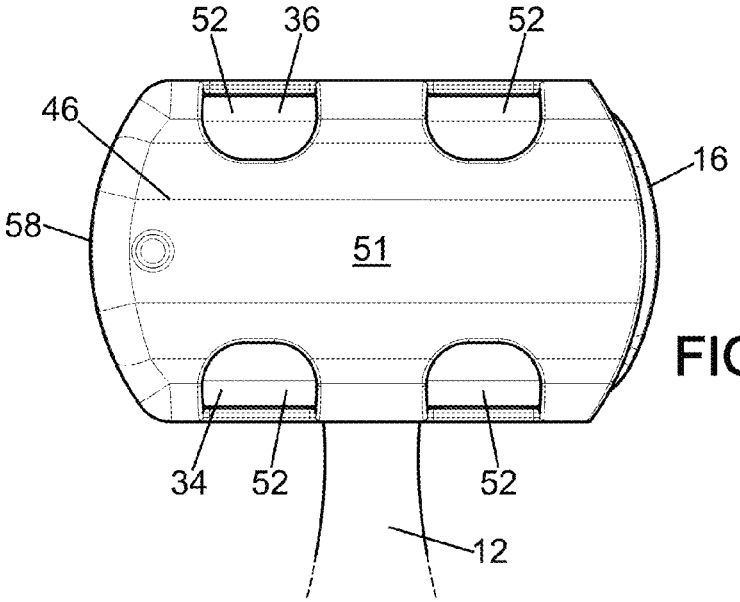
FIG. 13
FIG. 14
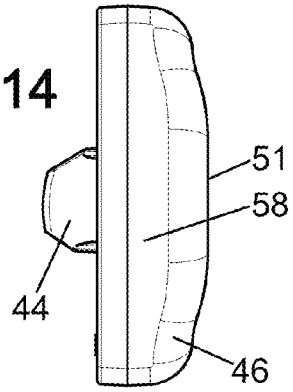

SHAVING BLADE ASSEMBLY WITH A BLADE UNIT AND A SKIN CONTACT MEMBER

FIELD OF THE INVENTION

The invention relates to a shaving blade assembly including a blade unit and a skin contact member, and a razor including a razor handle and such a shaving blade assembly.

BACKGROUND OF THE INVENTION

The shaving blade assemblies of the prior art commonly include a skin contact member provided with a shaving aid such as a lubricant, a moisturizer, a conditioner and/or an exfoliant to improve the gliding of the razor when shaving.

However, the shaving aid gets worn out, changing the dimensions of the shaving aid with respect to the blade assembly, and as a result, the user can experience nicks and cuts from the shave.

Therefore, the known shaving blade assemblies do not provide shaving in good conditions as soon as the shaving aid becomes worn. In addition, the manufacture of such known shaving blade assemblies is complicated since the skin contact member is commonly made of several materials (double and triple injection molding) and/or since a shaving aid is added on the skin contact member.

To this aim, a shaving blade assembly according to the embodiments of the present invention is provided with a specific geometry allowing a good shave during the entire life of the blades, where the user may enjoy better gliding of the razor, which provides for smooth skin, free of skin damages that usually results from shaving.

SUMMARY OF THE INVENTION

The embodiments of the present invention are related to shaving blade assemblies including a blade unit and a skin contact member, the blade unit including at least one shaving blade having a cutting edge, the blade unit having a blade unit skin contact surface area, the blade unit and the skin contact member having a shaving blade assembly skin contact surface area.

Such shaving blade assemblies allow maintaining a smooth relation between the blades and the skin during shaving in such a way that they can prevent any hard pressure from the blades to the skin.

One object of the embodiments of the present invention is to provide a shaving blade assembly including a blade unit and a skin contact member, the blade unit including at least one shaving blade having a cutting edge and having a shaving plane, where the skin contact member includes a leading skin contact part extending in front of the shaving blades and a trailing skin contact part extending rearward of the shaving blades, where the leading skin contact part includes a leading planar surface and the trailing skin contact includes a trailing planar surface, the leading planar surface and the trailing planar surface defining a contact plane, and where the contact plane and the shaving plane are parallel and the distance between the contact plane and the shaving plane is between approximately 0.2 mm and 0.6 mm.

Another object of the embodiments of the present invention is to provide a shaving blade assembly having a ratio between the shaving blade assembly skin contact surface area and the blade unit skin contact surface area which is between approximately 2 and 3.1.

An embodiment of the present invention includes a shaving blade assembly including a blade unit and a skin contact member. The blade unit includes: a housing; at least one shaving blade having a cutting edge; a first part of the housing in front of the cutting edge; a second part of the housing behind the cutting edge; and a shaving plane tangent to the first part and the second part. The skin contact member includes a leading skin contact part extending in front of the shaving blades and a trailing skin contact part extending rearward of the shaving blades. The leading skin contact part includes a leading planar surface and the trailing skin contact includes a trailing planar surface, the leading planar surface and the trailing planar surface defining a contact plane. The contact plane and the shaving plane are parallel, and the shaving plane is above the contact plane.

Another embodiment of the present invention includes a shaving blade assembly including a blade unit and a skin contact member. The blade unit includes a housing; at least one shaving blade having a cutting edge; and a blade unit skin contact surface area. The blade unit and the skin contact member have a shaving blade assembly skin contact surface area. A ratio between the shaving blade assembly skin contact surface area and the blade unit skin contact surface area is between approximately 2 and 3.1.

Yet another embodiment of the present invention includes a shaving blade assembly including a blade unit and a skin contact member. The blade unit includes at least one shaving blade having a cutting edge. The skin contact member includes a leading skin contact part extending in front of the shaving blades and a trailing skin contact part extending rearward of the shaving blades. The skin contact member is snap-fitted onto the blade unit.

There is no longer any need to provide the skin contact member with a shaving aid. The skin contact member of the embodiments of the present invention allows spreading the pressure that the user applies on a wider area of the skin and prevents the intense deformation of the skin that is caused by the blade unit without the skin contact member. The skin contact member of the embodiments of the present invention can be manufactured with a single injection molding process or the like. As a result, the manufacturing costs of the shaving blade assembly according to the embodiments of the present invention are generally cheaper than the prior art.

The skin contact member according to the embodiments of the present invention acts like a stretcher on the skin while allowing enhanced gliding of the razor. In addition, the skin contact member according to the embodiments of the present invention can be produced in a single production step, which means lower production cost and easier quality control.

The advantages of the embodiments of the present invention include a pleasant feeling of enhanced gliding and safety for the skin during shaving, the lack of damage to the skin, if by mistake or due to a faster motion the user applies more pressure than is normally the case during shaving. In other words, the skin contact member protects the user against wrong movements (such as, for example, in the lateral direction) and absorbs the excessive pressure that might provoke micro injuries and/or irritation on the skin. Based on the previous features, the skin contact member allows a faster, smoother shave.

In various embodiments of the present invention, one or more of the following features may be incorporated in the skin contact member alone or in mutual combination:

the blade unit has a blade unit skin contact surface area, the blade unit and the skin contact member have a shaving blade assembly skin contact surface area, where the ratio between the shaving blade assembly skin contact surface area and the blade unit skin contact surface area is between approximately 2 and 3.1;

the skin contact member is without any shaving aid; thus, the skin contact member does not include any shaving aid;

the blade unit further includes a guard and a cap; the guard is provided in front of the cutting edge, whereas the cap (which can be provided with a shaving aid or lubra) is located rearward of the cutting edge;

the skin contact member is "motionlessly" secured to the blade unit; motionless means that the skin contact member is not designed to deflect with respect to the blade unit during shaving; the skin contact member surrounds the blade unit; the skin contact member can, for example, be snap-fitted or the like to the blade unit;

the skin contact member includes a leading skin contact part extending forward of the shaving blade and a trailing skin contact part extending rearward of the shaving blade; in that case, the leading skin contact part preferably includes a leading planar surface and the trailing skin contact includes a trailing planar surface, the leading planar surface and the trailing planar surface defining a contact plane; in addition, in that case, the leading skin contact part preferably further includes a leading longitudinal face which is connected to the leading planar surface via a leading curved face and where the trailing skin contact part further includes a trailing longitudinal face which is connected to the trailing planar surface via a trailing curved face; the leading longitudinal face is substantially perpendicular to the leading planar surface and where the leading curved face has a radius of curvature of about 2 mm; similarly, the trailing longitudinal face is substantially perpendicular to the trailing planar surface and where the trailing curved face has a radius of curvature of about 2 mm;

the contact plane is above a shaving plane defined by the housing;

the contact plane and the shaving plane are parallel and the distance between the contact plane and the shaving plane is preferably between approximately 0.2 mm and 0.6 mm; the distance between the two planes provides a safe distance between the blade unit and the skin, especially between the blades and the skin, which allows for a fast, smooth, and safer shave;

the ratio between the shaving blade assembly skin contact surface area and the blade unit skin contact surface area is preferably about 2.5, and the contact plane and the shaving plane are parallel, and the distance between the contact plane and the shaving plane is preferably about 0.3 mm;

the skin contact member includes a material such as plastics, metals, and/or lacquered wood addition, or the like. The skin contact member has a friction coefficient between approximately 0.3 and 0.7 when it includes a plastic, a friction coefficient between approximately 1.05 and 1.35 when it includes a metal, or a friction coefficient between approximately 0.25 and 0.5 when it includes lacquered wood addition; these materials and values of friction coefficient provide a better stretching to the skin as current shavers using a high friction material, like TPE, to grab skin and pull it while shaving. The friction coefficient values indicated here are without the use of any lubricant.

The shaving blade assembly further includes a protective cover for shielding the cutting edge;

such a protective cover is slidable and is provided with a locker to hold the protective cover in a full stop position;

the skin contact member comprises a locker slot shaped to receive the locker of such a protective cover;

the skin contact member can have thermochromic pigments, thus it can be used to pass information to the user.

Another object of the embodiments of the present invention is to provide a razor including a razor handle and such a shaving blade assembly, the shaving blade assembly being provided with connecting means for connecting the shaving blade assembly to the razor handle. The razor handle can be connected to the shaving blade assembly pivotally or not; when the connection is pivotable, the connecting means preferably includes shell bearings provided on the blade unit.

BRIEF DESCRIPTION OF THE DRAWINGS

Preferred features of the embodiments of the present invention are disclosed in the accompanying drawings, wherein similar reference characters denote similar elements throughout the several views, and wherein:

FIG. 12 is rear perspective view of the razor of FIG. 11;

FIG. 13 is a front view of the razor of FIG. 10 with the protective cover attached; and FIG. 14 is a lateral view of the razor of FIG. 13.

DETAILED DESCRIPTION OF THE INVENTION

Figure 1:
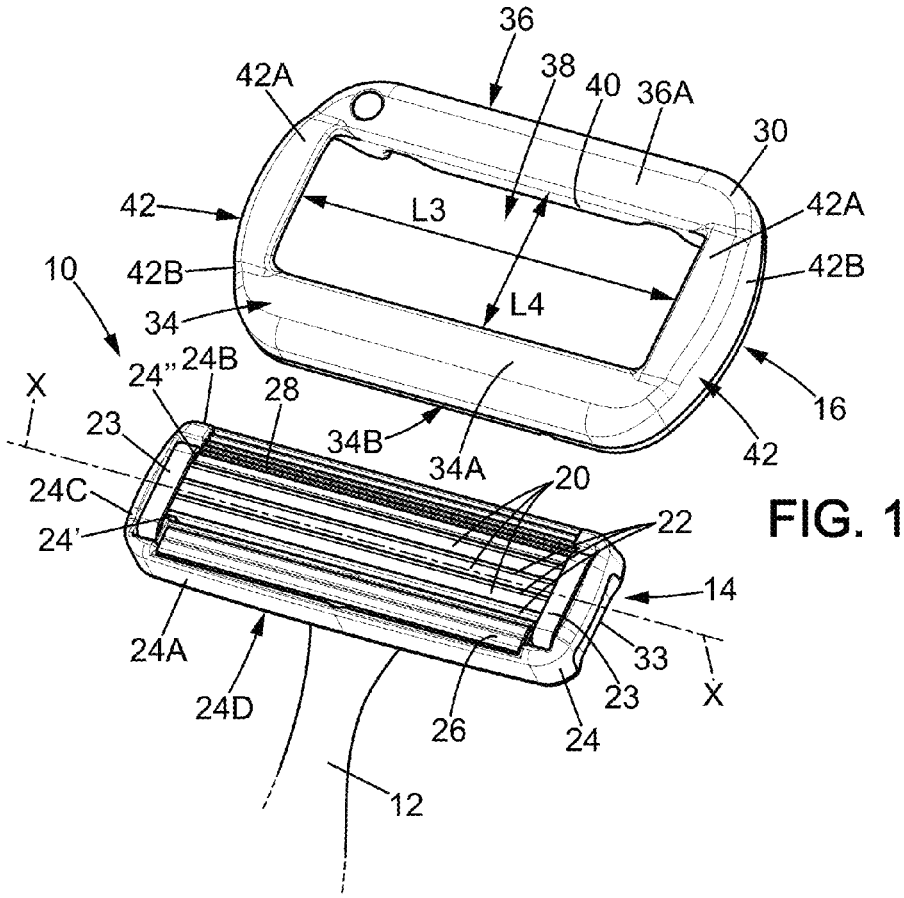
FIG. 1 is a front perspective view of a partially exploded razor according to an embodiment of the present invention.

The embodiments of the present invention will now be described more fully hereinafter with reference to the accompanying drawings, in which preferred embodiments of the invention are shown. This invention may, however, be embodied in many different forms and should not be construed as limited to the illustrated embodiments set forth herein. Rather, these illustrated embodiments are provided so that this disclosure will be thorough and complete and will convey the scope of the invention to those skilled in the art.

In the following description, like reference characters designate like or corresponding parts throughout the figures. Additionally, in the following description, it is understood that terms such as "top," "bottom," "side," "front," "back," "inner," "outer," and the like, are words of convenience and are not to be construed as limiting terms.

The figures illustrate a razor 10 according to an embodiment of the present invention, including a razor handle 12, a shaving blade assembly including a blade unit 14 and a skin contact member 16 that can be connected to the blade unit 14 as illustrated in the figures to form a shaving blade assembly 18.

As depicted in the figures, the blade unit 14 has one or more shaving blades 20, each of the shaving blades 20 being provided with a cutting edge 22. More precisely, the blade unit 14 includes a housing 24 that has a front edge 24A and a rear edge 24B, an upper face 24C and an opposed lower face 24D, and into which the one or more shaving blades 20 are located (between the front edge and the rear edge). The shaving blades 20 are either movably mounted on elastic fingers provided on the housing or fixed. When movable, the blades 20 can be secured on the housing 14 with clips 23. The number of shaving blades 20 might be between one and five for example, and is preferably three or four blades.

The housing 24 is preferably elongated, extending along a longitudinal axis X-X.

A guard bar 26 and respectively a cover 28 might also be provided on the upper face 24C of the housing 24, respectively in front (i.e., forward) of the shaving blades 20 and aft of them (i.e., rearward or back). When the blade unit includes several blades 20, forward of the blade edge 22 means forward of the forward-most blade edge and rearward means rearward of the rearward-most blade edge.

The cover 28 can be provided with a shaving aid, commonly named lubra (such as a lubricant, a moisturizer, a conditioner and/or an exfoliant) or lubricating strip. The guard bar 26 can include an elastomeric material that is preferably provided with longitudinal fins that are preferably parallel to the longitudinal axis X-X.

The cutting edge 22 of each shaving blade 20 extends preferably longitudinally along the longitudinal axis X-X toward the guard bar 26.

The housing 24 further comprises a first part 24' located forward the blade edge 22 and a second part 24" located rearward the blade edge 22. As best visible on FIG. 5, when the housing 24 is provided with a guard bar 26, the first part 24' is located between the forward-most blade edge 22 and the guard bar 26; similarly, when the blade unit 24 is provided with a lubra 28, the second part 24" is located between the rearward-most blade edge 22 and the lubra 28. Both the first part 24' and the second part 24" can each be reduced to a point or even be nonexistent.

The skin contact member 16 can be a separate member provided on a frame 30 and thus be attachable to the blade unit 14. The skin contact member 16 receives, preferably via a friction fit, the blade unit 14 such that it can be mounted and naturally maintained on the blade unit 14. This means that, in an embodiment of the present invention, the frame 30 of the skin contact member 16 is designed to cooperate via a friction fit with the housing 24 of the blade unit 14. In an embodiment of the present invention, the skin contact member 16 includes lateral parts 40 that assist in providing a friction fit to the blade unit 14. In an embodiment of the present invention in which the skin contact member 16 is attached to the blade unit 14 via a friction fit, the skin contact member 16 is removable by a user disengaging the skin contact member 16 from the blade unit 14 using a significant amount of force. Alternatively, in an embodiment of the present invention in which the skin contact member 16 is attached to the blade unit 14 via a friction fit, the skin contact member 16 is permanently attached to the blade unit 14 and is not removable.

The skin contact member 16 can also be elastically mountable on the blade unit 14; more precisely, the frame 30 of the skin contact member 16 might deform elastically during its connection to the blade unit 14. This means that the elasticity of the frame 30 is higher than that of the shaving housing 24. For example, in an embodiment of the present invention, the lateral parts 40 deform elastically to attach the skin contact member 16 to the blade unit 14. Alternatively or in addition, in an embodiment of the present invention, the housing 24 of the blade unit 14 deforms elastically to allow for elastic attachment to the skin contact member 16. In another embodiment of the present invention, the protrusions 32 or the like deform elastically to attach the skin contact member 16 to the blade unit 14. In an embodiment of the present invention in which the skin contact member 16 is attached to the blade unit 14 via an elastic fit, the skin contact member 16 is removable by a user disengaging the skin contact member 16 from the blade unit 14 using a significant amount of force or adjusting the skin contact member 16 in a certain manner. Alternatively, in an embodiment of the present invention in which the skin contact member 16 is attached to the blade unit 14 via an elastic fit, the skin contact member 16 is permanently attached to the blade unit 14 and is not removable.

In another embodiment of the present invention, the skin contact member 16 is attachable to the blade unit 14 via a snap-fit through the protrusions 32 and cooperating recesses 33 as explained in more detail herein. In an embodiment of the present invention in which the skin contact member 16 is attached to the blade unit 14 via a snap-fit, the skin contact member 16 is removable by a user disengaging the skin contact member 16 from the blade unit 14 using a significant amount of force. Alternatively, in an embodiment of the present invention in which the skin contact member 16 is attached to the blade unit 14 via a snap-fit, the skin contact member 16 is permanently attached to the blade unit 14 and is not removable.

As stated above, according to the friction forces, elasticity, and/or snap-fitting of the skin contact member 16, after mounting, the skin contact member 16 can be permanently connected to the blade unit 14 or preferably releasably (i.e., detachably) connected to the blade unit 14. When the skin contact member 16 is releasably connected to the blade unit 14, the friction between the skin contact member 16 and the blade unit 14 might be such that the skin contact member 16 is maintained on the blade unit 14 such that it allows for shaving without any risk of detachment. In addition, in an embodiment of the present invention, the voluntary release/detachment of the skin contact member 16 from the blade unit 14 can be realized without using a significant force (e.g., the separation of the skin contact member from the blade can be obtained without the help of any tool).

Figure 3:
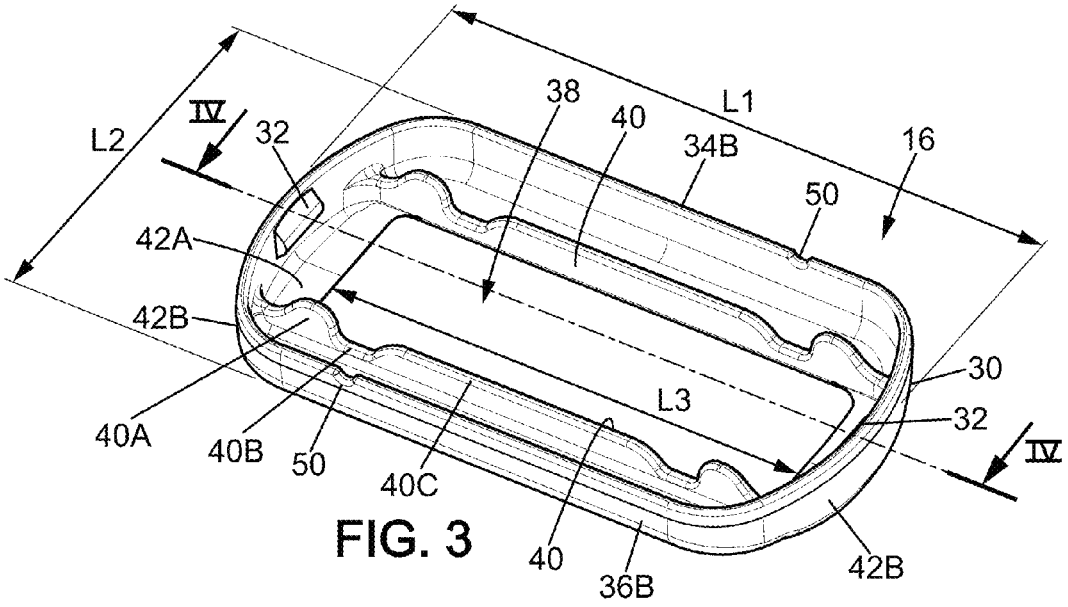
FIG. 3 is a rear perspective view of the skin contact member according to an embodiment of the present invention.
Figure 4:
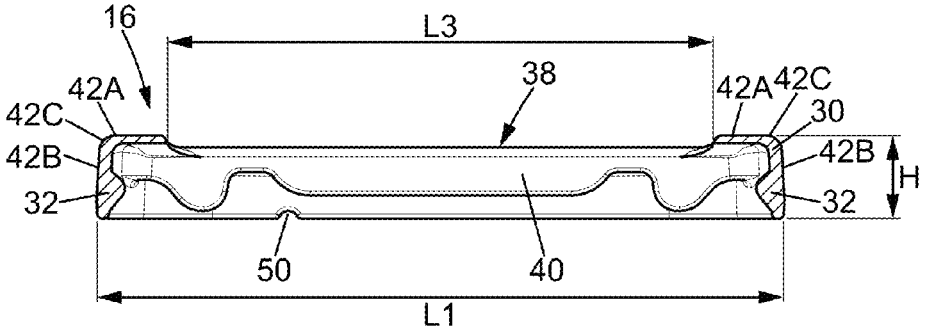
FIG. 4 is a longitudinal sectional view of the skin contact member of FIG. 3 along line IV-IV.

In an embodiment of the present invention, the skin contact member 16 is motionlessly secured to the blade unit (i.e., the skin contact member 16 is unable to move relative to the blade unit 14). As stated above, the skin contact member 16 can, for example, be snap-fitted to the blade unit 14. As best seen in FIGS. 3 and 4, one or more protrusions 32 can be provided on the frame 30 to allow the attachment to the blade unit 14 and firmly maintain the skin contact member 16 onto the blade unit 14 after said snap-fitting occurs. Thus, in an embodiment of the present invention, when attached to the housing 24, the skin contact member 16 cannot move and/or deflect with regard to the housing 24. In an alternate embodiment of the present invention, when attached to the housing 24, the skin contact member 16 is able to move and/or deflect with regard to the housing 24. In fact, embodiments of the present invention include, but are not limited to, designs where: (i) the skin contact member 16 is attached to the blade unit 14 via a friction fit and the skin contact member cannot move and/or deflect with regard to the housing 24; (ii) the skin contact member 16 is attached to the blade unit 14 via a friction fit and the skin contact member is able to move and/or deflect with regard to the housing 24; (iii) the skin contact member 16 is attached to the blade unit 14 via an elastic fit and the skin contact member cannot move and/or deflect with regard to the housing 24; (iv) the skin contact member 16 is attached to the blade unit 14 via an elastic fit and the skin contact member is able to move and/or deflect with regard to the housing 24; (v) the skin contact member 16 is attached to the blade unit 14 via a snap-fit and the skin contact member cannot move and/or deflect with regard to the housing 24; and (vi) the skin contact member 16 is attached to the blade unit 14 via a snap-fit and the skin contact member is able to move and/or deflect with regard to the housing 24.

The skin contact member 16 preferably surrounds the blade unit 14 as depicted in the figures, but one of ordinary skill will understand that the present invention is not limited to this geometry.

The skin contact member 16 can include a leading skin contact part 34 extending in front of the shaving blades 20 and a trailing skin contact part 36 extending rearward of the shaving blades 20. More precisely, the leading skin contact part 34 is located in front of the forward-most blade and the trailing skin contact part 36 is located aft of the rearward-most blade (when the skin contact member 16 is mounted on the blade unit 14). In addition, the skin contact member 16 can include thermochromic pigments, which can be used to pass information to the user. For example, the pigments can color the skin contact member 16 in blue when it is too cold for improving shaving; the pigments can color the skin contact member 16 in red when it is too hot for improving shaving (and there is a risk of burning); and the pigments can color the skin contact member 16 in pink when it is ready for use. The pigments provided on the skin contact member 16 can thus give indications to the user because they can change color according to the temperature of the skin contact member 16.

Figure 5:
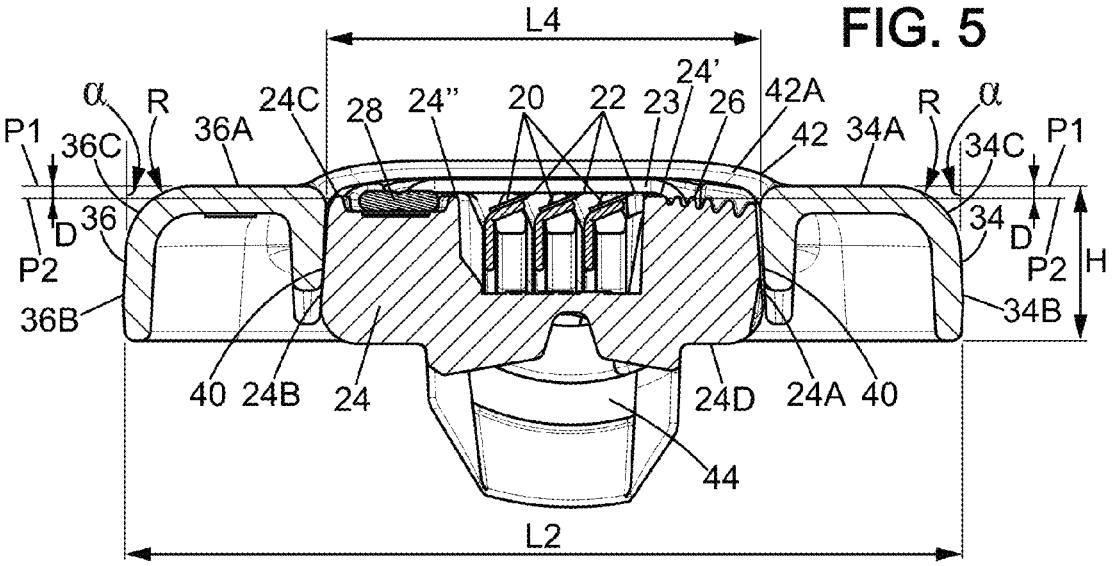
FIG. 5 is a transversal sectional view of the razor of FIG. 2 along line V-V.

As best seen in FIG. 5, the leading skin contact part 34 preferably includes a leading planar surface 34A and the trailing skin contact part 36 preferably includes a trailing planar surface 36A. The leading planar surface 34A and the trailing planar surface 36A define a contact plane P1.

In addition, the first part 24' and the second part 24" of the housing 24 define a shaving plane P2. In other words, the shaving plane P2 is tangent to the first part 24' and the second part 24" of the housing 24. When one of the first part 24' or the second part 24" of the housing 24 is reduced to a line, the shaving plane P2 is the plane tangent to the lines.

The blade edge 22 of each of the blades 20 provided in the housing 24 can have an exposure which is positive, negative, or null (equal to zero) with regard to the shaving plane P2. When the blade unit is provided with at least two blades 20 having the same exposure, a cutting edge plane (not illustrated) corresponding to the plane in contact with the two cutting edges 22 can be defined. When the blade unit is provided with several blades 20, the exposure of the blade edges can be progressively continuous, increasing, and/or decreasing from one blade to the other. The cutting edge plane is above the shaving plane P2 when the blades exposure is positive, and the cutting edge plane is below the shaving plane P2 when the blades exposure is negative. The cutting edge plane and the shaving plane P2 coincide when the exposure of the blades is equal to zero with regard to said shaving plane P2. When the blades are movable, the exposure is given in their at-rest position.

When connected onto the blade unit 14, the contact plane P1 of the skin contact member 16 is substantially parallel to and above the shaving plane P2 defined by the housing 24. Preferably, the distance D between the contact plane P1 and the shaving plane P2 is between approximately 0.2 mm and 0.6 mm and is preferably about 0.3 mm. In other words, the first part 24' and the second part 24" of the housing 24 are located underneath the contact plane P1; this leads to an improvement in shaving and reduced risk of inadvertently cutting the skin when the user shaves. When the distance D is greater than 0.6 mm, it can lead to reduced closeness, whereas when it is smaller than 0.2 mm the efficiency of the shaving can be reduced.

According to the blade exposure defined above with regard to the shaving plane P2, the blade edge 22 of each blades 20 can be above, below, or tangent to the shaving plane P2. A negative exposure as mentioned above with regard to the shaving plane P2 leads automatically to a negative exposure of the blades with regard to the contact plane P1. The same appears when the blade edge 22 is tangent to the shaving plane P2, a negative exposure of the blade is obtained with regard to the contact plane P1. When the exposure is positive with regard to the shaving plane P2, the exposure of the blade edge 22 with regard to the contact plane P1 can be positive, negative, or equal to zero, according to the value of the positive exposure of the blade edge 22 with regard to the shaving plane P2 and according to the distance D between the contact plane P1 and the shaving plane P2. When the positive exposure with regard to the shaving plane P2 of the blade edge 22 is smaller than D, than the exposure of the blade edge 22 is negative with regard to the contact plane P1. Should the positive exposure with regard to the shaving plane P2 of the blade edge 22 be greater than D, than the exposure of the blade edge 22 would be positive with regard to the contact plane P1. For example, when the exposure of the blade edge 22 is equal to 100 μm with regard to the shaving plane P2, the exposure of the blade edge 22 with regard to the contact plane P1 will be negative (D being between 0.2 mm and 0.6 mm). In a preferred embodiment of the present invention, the exposure of each of the blade edges 22 with regard to the contact plane P1 is negative.

The leading skin contact part 34 can further include a leading longitudinal face 34B which is connected to the leading planar surface 34A via a leading curved face 34C. In a same way, the trailing skin contact part 36 can further comprise a trailing longitudinal face 36B which is connected to the trailing planar surface 36A via a trailing curved face 36C.

The leading longitudinal face 34B is preferably substantially perpendicular to the leading planar surface 34A and extends longitudinally to the longitudinal axis X-X in front of the housing 24. More precisely, the leading longitudinal face 34B extends in front of the front edge 24A of the housing 24.

In addition, the trailing longitudinal face 36B is also preferably substantially perpendicular to the trailing planar surface 36A and extends longitudinally to the longitudinal axis X-X rearward of the housing 24. More precisely, the trailing longitudinal face 36B extends behind the rear edge 24B of the housing 24.

In an embodiment of the present invention, each longitudinal face (leading 34B and trailing 36B) is connected to the respective planar surface (leading 34A and trailing 36A) by a curved face (leading 34C and trailing 36C). Both the leading curved face 34C and the trailing curved face 36C preferably have a radius of curvature R between approximately 1 mm and 3 mm, preferably about 2 mm.

Figure 2:
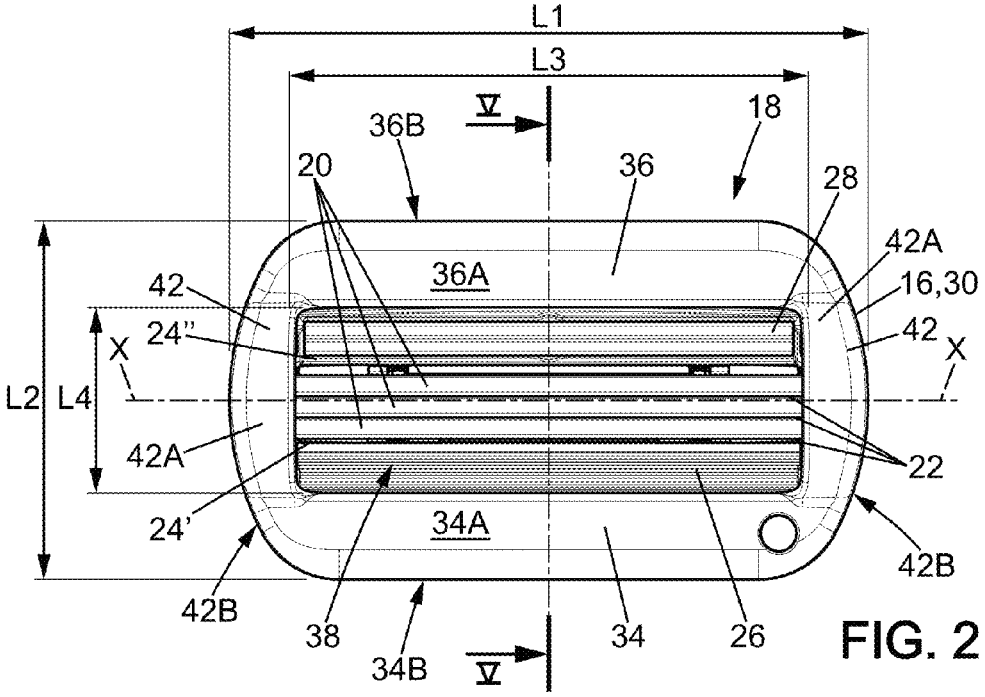
FIG. 2 is a front view of a shaving blade assembly according to an embodiment of the present invention.

The frame 30 including the skin contact member 16 can, as already mentioned above, can be a separate element connected to the blade unit 14 and can surround it as depicted in the drawings. In that case, the frame 30 is preferably provided with an opening 38 through which the cutting edges 22 are accessible when mounted on the blade unit 14 as best depicted in FIG. 2. This opening 38 is preferably shaped in order to fit the housing 24. More precisely, the frame 30 includes an inner wall which has at least two lateral parts 40 cooperating respectively with the front edge 24A and the rear edge 24B of the housing.

The frame 30 can further include at least two transversal parts 42 connecting the leading skin contact part 34 and the trailing skin contact 36 on either side of the blade unit 14.

Each transversal part 42 preferably includes a transversal surface 42A encasing a part of the upper face 24C of the housing 24 and the lateral face 42B. The transversal surface 42A is preferably connected to the lateral face 42B via a curved face 42C having a radius curvature R that is preferably about 2 mm. The transversal surfaces are shaped such that they fit onto the upper face 24C. For example, the blade unit 14 depicted in the figures is provided with clips 23, and the transversal surfaces are shaped such that they fit onto and over the clips 23.

The lateral faces 42B, the leading longitudinal face 34B, and the trailing longitudinal face 36B are connected in order to form a peripheral wall of the frame 30, where the peripheral wall encases the housing 24. This peripheral wall is provided with a rounded corner between each of lateral faces 42B and respective leading longitudinal face 34B and trailing longitudinal face 36B, as best seen in FIG. 3.

The geometry of the frame 30, especially its lateral parts 40 and its transversal surfaces 42A, taken in combination with the protrusions 32, leads to an improvement of the mounting and maintaining of the frame 30 on the housing and thus leads to a better control of the distance D between the contact plane P1 and the shaving plane P2 as best shown in FIG. 5. The protrusions 32 can be located anywhere on the frame 30 such that they are in contact with housing 24. As depicted in FIGS. 3 and 4, at least two protrusions can be provided on the inner side of the frame 30 preferably laterally opposed to each other on a lateral face 42B of the frame 30, between the lateral parts 40. These protrusions 32 are designed to come in contact with the housing 24, more precisely with recesses 33 provided on the housing 24 (as best seen in FIG. 1). The protrusions 32 may be wedge shaped protrusions (as shown in the figures), knob shaped, semicircular shaped, ribs, or the like.

In order to improve the shaving, the shaving blade assembly according to an embodiment of the present invention has a specific configuration. More precisely, a blade unit skin contact surface area S1 can be defined in relation with the blade unit 14, and a shaving blade assembly skin contact surface area S2 can be defined in relation with the blade unit 14 and the skin contact member 16.

Figure 6A:
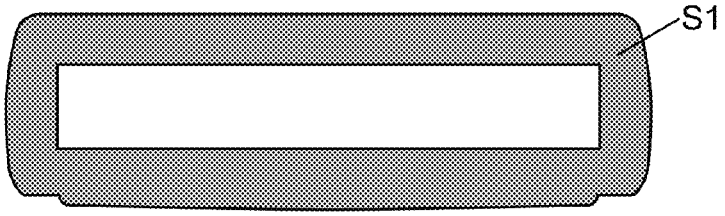
FIG. 6A is a schematic upper view of a blade unit skin contact surface area according to an embodiment of the present invention.

As depicted schematically in FIG. 6A, such a blade unit skin contact surface area S1 corresponds to the surface of the blade unit in contact with the skin during shaving; specifically, the blade unit skin contact surface area S1 includes the upper face 24C of the housing (with the guard bar 26 and the lubra 28) and the clips 23. The blades included in the housing are not taken into account because their contact with the skin is more or less null. Besides, when the blades are movable, this contact surface changes during shaving but it does not change the area and ratios, which remain the same.

Figure 6B:
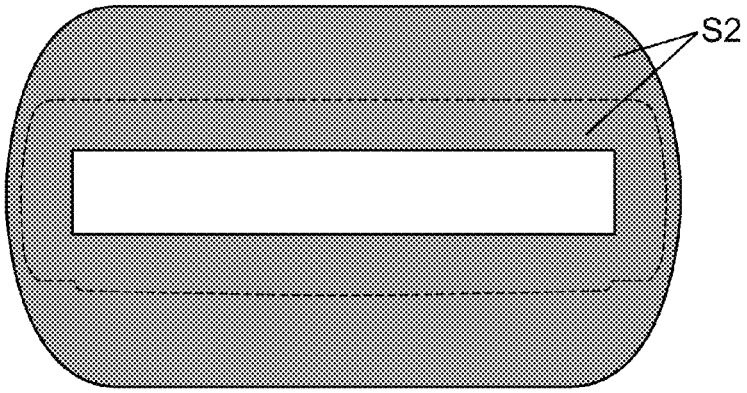
FIG. 6B is schematic upper view of a shaving blade assembly skin contact surface area according to an embodiment of the present invention.

As depicted schematically in FIG. 6B, the shaving blade assembly skin contact surface area S2 corresponds to the surface of the skin contact member 16 and of the accessible surface of the blade unit accessible through the skin contact member 16 and in contact with the skin during shaving. Specifically, the accessible surface of the blade unit includes the lubra and the guard which are on the shaving head plane, which is in vertical distance with the adaptor top surface plane. The shaving blade assembly skin contact surface area S2 includes the two transversal surfaces 42A, the leading planar surface 34A, the trailing planar surface 36A, and a part of the upper face 24C of the housing (with the guard bar 26 and the lubra 28). In the embodiment depicted in the figures, there are clips 23 provided on the blade unit 24, which are not considered since they are covered by the transversal surfaces 42A. If the blades are secured to the housing with another element than the clips it might be considered or not for the shaving blade assembly skin contact surface area S2 according to its position with regard to the opening provided in the skin contact member. In addition, as explained above, the blades included in the housing are also not taken into account.

During shaving, the razor 10 is applied against the skin to be shaved. Some parts of the razor thus enter in contact with the skin and forces act in reaction to this application of the razor against the skin S (see FIG. 9). The force distribution is to be connected to the surface of the razor in contact with the skin. The an embodiments of the present invention optimize the surface in contact with the skin in order to obtain a safer shaving and provide a pleasurable shaving experience (improved gliding, softness, and/or skin hydration, as well as reduced shaving time).

Figure 8:
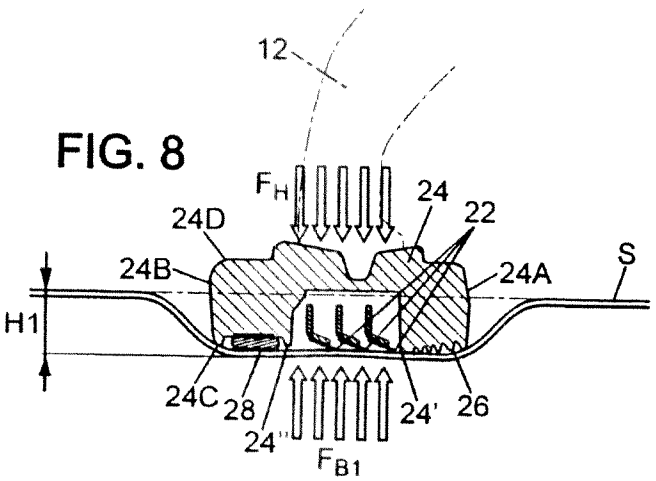
FIG. 8 is a schematic transversal sectional view of a razor of the prior art during shaving.

If the shaving occurs with a razor provided with a blade unit 14 onto which no skin contact member 16 is provided (meaning a razor of the prior art), the skin will deform as depicted schematically in FIG. 8 with a deformation or penetration of the skin of H1.

Figure 9:
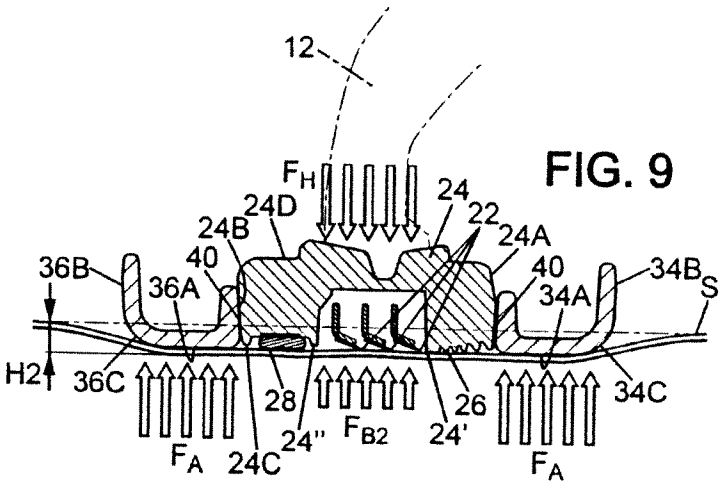
FIG. 9 Prior Art
FIG. 9 is a schematic transversal sectional view of a razor according to an embodiment of the present invention during shaving.

If the shaving occurs with a razor provided with a blade unit 14 onto which a skin contact member 16 is provided the skin will deform as depicted schematically in FIG. 9 with a deformation or penetration of the skin of H2.

The skin deforms differently when the razor is provided with a skin contact member 16 according to the embodiments of the present invention. A smoother contact is obtained with the razor of the embodiments of the present invention. The height H2 is always smaller than H1.

In addition, during shaving the razor applies a force $F_H$ against the skin with a razor handle; in response, a total force $F_{Total}$ occurs. For ease of presentation, arrows show the distribution of the forces of interest, where:

$F_A$: reaction force from the skin to the skin contact member 16;

$F_{B1}$: reaction force from the skin to the razor in the case where no skin contact member 16 is used; and $F_{B2}$: reaction force applied from the skin to the shaving head in the case where the skin contact member 16 is used.

Both forces $F_H$ and $F_{Total}$ are equal in both cases (with and without the skin contact member 16).

In reference to the razor of FIG. 8 (without the skin contact member 16), the total force $F_{Total}$ is in this case equal to the force applied from the skin to the razor, that is $F_{Total}=F_{B1}=F_H$.

In reference to the razor according to the embodiment of the present invention as depicted in FIG. 9 (with the skin contact member 16), the total force $F_{Total}$ in this case is equal to the force applied from the skin to the razor, that is $F_{Total}=F_A+F_{B2}=F_H$.

Without the skin contact member 16, the razor causes an intense deformation that creates the depth H1 into the skin. Furthermore, the concentration of the contact forces $F_{B1}$ is a result of the Force $F_H$ that is applied on the skin on an area equal to the shaving head front area, which is significantly smaller with respect to the skin protector front area. In the embodiments of the present invention, the skin contact member 16 is in contact with the skin and it absorbs a greater percentage of the total forces. As a result, less force is applied to the skin from the blades than in the previous case where no skin contact member 16 is used: $|F_{B2}|<|F_A|$, $|F_{B2}|<|F_{B1}|$.

As seen in FIG. 9, with the skin contact member 16, the Force $F_H$ is distributed on a larger area under the razor and the skin contact member 16 causes a significantly less intense and smoother skin deformation creating a depth H2 which is smaller than H1. The shape of the skin's local deformation is also reduced when a skin contact member 16 is provided. As a result, the skin protector adaptor provides a safe distance between the blades and the skin with improved gliding, thus reducing nicks, cuts, and irritation.

Figure 7:
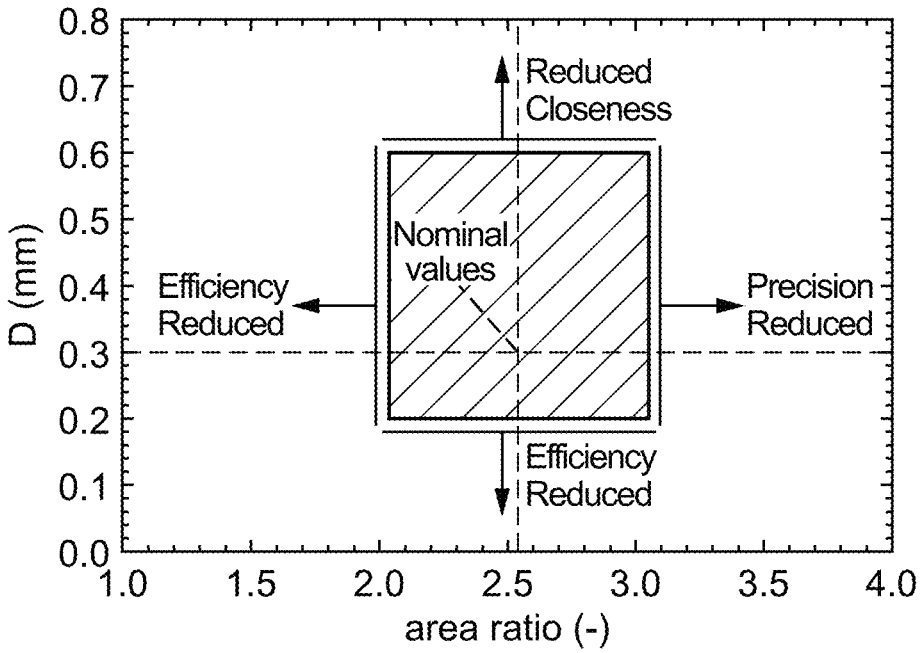
FIG. 7 is a graph representing an operating window relating to the ratio and the distance between the contact plane and the shaving plane according to an embodiment of the present invention.

As illustrated on the graph depicted in FIG. 7, results for improving the shaving, gliding, and security while reducing the time needed to shave is obtained when the ratio S2/S1 between the shaving blade assembly skin contact surface area S2 and the blade unit skin contact surface area S1 is between approximately 2 and 3.1. The efficiency of shaving is reduced when the ratio S2/S1 is smaller than 2 and the precision of shaving is reduced when the ratio S2/S1 is greater than 3.1.

The preferred results of shaving (cutting, softness, gliding, etc.) are obtained with a shaving blade assembly having a ratio S2/S1 between approximately 2 and 3.1 and a distance D between the contact plane P1 and the shaving plane P2 between approximately 0.2 mm and 0.6 mm; preferably, the nominal values for which the best results are obtained can be an ideal design of the shaving blade assembly where the ratio S2/S1 is about 2.5 and the distance D is about 0.3 mm.

Several kinds of materials can be used for the skin contact member 16. The skin contact member 16 is however preferably made in one piece and includes a sole material. The preferred materials can be plastic (for example, including, but not limited to ABS or high polished thermoplastic) and metal (or example, including, but not limited to aluminum of light alloy), or a lacquered wood addition. The roughness of the material of the skin contact member 16, especially for the leading planar surface 34A and the trailing planar surface 36A is such that the friction coefficient against the skin leads to a good stretch of the skin and good gliding. For example, the friction coefficient can be between approximately 0.3 and 0.7 when the skin contact member 16 includes a plastic as mentioned above. The friction coefficient can be between approximately 1.05 and 1.35 when the skin contact member 16 includes a metal as mentioned above. The friction coefficient can be between approximately 0.25 and 0.5 when the skin contact member 16 includes lacquered wood addition as mentioned above. Such a skin contact member 16 is as if it was lubricated.

The skin contact member 16 according to the embodiments of the present invention acts against the skin especially in stretching it in front of the blade edges 22 such that the hair extends more or less perpendicular to the contact plane P1. In addition, the skin contact member 16 according to the embodiments of the present invention acts against the skin in spreading any shaving aid (such as shaving cream and regular soap) possibly put on the skin, and the penetration of the shaving aid is improved. The skin is better hydrated when the shaving aid includes a hydrating product.

We will now disclose an example of the geometry of a shaving blade assembly 18 according to an embodiment of the present invention. The skin contact member 16 can have a length L1 along the longitudinal axis X-X between approximately 40 mm and 50 mm, preferably about 45 mm. The skin contact member 16 can have a width L2 taken substantially perpendicular to the longitudinal axis X-X between approximately 20 mm and 30 mm, preferably about 25 mm. These dimensions are measured at their maximum values, especially when the skin contact member 16 has curved lateral faces 42B as depicted in the figures. The skin contact member 16 is preferably symmetric with regard to the longitudinal axis X-X. The opening 38 of the skin contact member 16 is preferably centered. Its dimensions are adapted to fit on the housing 24 of the blade unit 14. For example, for a blade unit provided with three blades 20 and clips 23, the opening 38 is preferably substantially rectangular when viewed from the upper side and can have a length L3 taken along the longitudinal axis X-X between approximately 30 mm and 40 mm, preferably 35 mm and a width L4 taken substantially perpendicular to the longitudinal axis X-X between approximately 8 mm and 20 mm, preferably about 12 mm.

The above dimensions L1 and L3 taken along the longitudinal axis X-X are preferably the same whether they are measured on the upper side of the skin contact member 16 or on its lower side. The lateral faces 42B are preferably each planar and substantially perpendicular to the contact plane P1 defined by the leading planar surface 34A and the trailing planar surface 36A.

The above dimensions L2 and L4 taken perpendicularly to the longitudinal axis X-X are preferably varying a bit along the height of the surfaces. More precisely, the length L2 is preferably measured on the lower side (between the free ends of the leading longitudinal face 34B and of the trailing longitudinal face 36B, opposite the leading curved face 34C and the trailing curved face 36C) of the skin contact member 16; it can be less important when measured on the upper side of the skin contact member 16. The leading longitudinal face 34B and the trailing longitudinal face 36B can be slightly inclined with regard to a perpendicular to the contact plane P1. Preferably the leading longitudinal face 34B and the trailing longitudinal face 36B can each have an angle $\alpha$ measured with regard to the contact plane P1 which is between approximately 85° and 95°, preferably about 92°.

The lateral parts 40 of the inner wall of the skin contact member 16 fit to the housing 24 and can also be slightly inclined with regard to a perpendicular to the contact plane P1. Thus, the value given for the width L4 is measured on the upper side of the skin contact member 16. L3 and L4 correspond to the dimensions of the opening 38, they are preferably measured on the upper side of the skin contact member 16 in order to be sure to have an opening sufficient such that the blades 20, the guard bar 26, and the lubra 28 are accessible through the opening 38 during shaving.

The height H of the skin contact member 16 can be measured between the contact plane P1 and the free ends of the leading longitudinal face 34B and the trailing longitudinal face 36B (respectively opposite the leading curved face 34C and the trailing curved face 36C) is preferably between approximately 3 mm and 7 mm, preferably about 5 mm.

The shaving blade assembly is provided with connecting means for connecting the shaving blade assembly 18 to the razor handle 12. More precisely, either the blade unit 14 or the skin contact member 16 can be provided with connecting means for connecting the shaving blade assembly 18 to the razor handle 12. According to the connecting means, the connection between the razor handle 12 and the shaving blade assembly 18 can be either fixed or pivotable. The connections means includes, but is not limited to, shell bearings and a cam follower system that allow the shaving blade assembly 18 to pivot about the handle 12.

In the examples depicted in the figures, the connecting means 44 (as best seen on FIG. 5) allow a pivoting of the shaving blade assembly 18 with regard to the razor handle 12 (around the elongated axis X-X), but the embodiments of the present invention are not limited to a pivotable shaving blade assembly. As illustrated, the connecting means 44 are preferably provided on the blade unit 14 on the lower face 24D of the housing 24.

The connecting means 44 can include shell bearings, especially when the shaving blade assembly 18 is pivotable with regard to the razor handle 12, but the embodiments of the present invention are not limited to this kind of connecting means. In addition, the handle 12 can be detachable from the blade unit 14 or non-detachable according to the razor. More precisely, the handle 12 is detachable when the razor is a system (meaning the blade unit 14 is changed by a new one when the blades 20 are dulled, while the handle 12 is kept), whereas the handle is non-detachable when the razor is a disposable one (meaning both the blade unit 14 and the handle 12 are changed by new ones when the blades are dulled).

The skin contact member 16 preferably receives frictionally the blade unit 14 such that it can be mounted and naturally maintained on the blade unit 14. This means that the frame 30 of the skin contact member 16 is designed to frictionally cooperate with the housing 24 of the blade unit 14.

The skin contact member can also be elastically mountable on the blade unit. More precisely, the frame 30 of the skin contact member might deform elastically during its connection to the blade unit 14. This means that the elasticity of the frame 30 is higher than that of the shaving housing 24 in an embodiment of the present invention. To this extent, the inner wall and especially the lateral parts 40 can have a non-contiguous shape and can be provided with "waves" in order to increase the elasticity of the inner wall especially during the mounting of the skin contact member 16 onto the housing 24.

According to the friction forces and to the elasticity of the skin contact member, after mounting, the skin contact member 16 can be permanently connected to the blade unit 14 or preferably releasably (i.e., detachably) connected to the blade unit 14. When the skin contact member 16 is releasably connected to the blade unit 14, the friction between the skin contact member 16 and the blade unit 14 might be such that the skin contact member 16 is maintained on the blade unit 14 such that it allows shaving without any risk of detachment. In addition, the voluntary release/detachment of the skin contact member 16 from the blade unit 14 can be realized without using a significant force (e.g., the separation of the skin contact member from the blade unit can be obtained without the help of any tool).

As shown in FIG. 1, and more clearly in FIGS. 3 and 4, the underside of the skin contact member 16 includes parallel legs, which may be in the form of the lateral parts 40, that provide a friction fit or elastic fit between the skin contact member 16 and the blade unit 14 when they are attached. The figures show a preferred embodiment of the friction fit design with each leg 40 being adjacent to the opening 38 (window) and preferably including a convex ear 40A substantially disposed toward the end of each leg 40. In an embodiment of the present invention, each ear 40A includes an apex that is substantially equal to the height of the leading longitudinal face 34B and trailing longitudinal face 36B. Alternatively, the apex may be slightly less (or slightly more) than the height of the leading longitudinal face 34B and trailing longitudinal face 36B. In an embodiment of the present invention, each leg 40 also preferably includes a valley 40B adjacent to the ears 40A, and a substantially straight horizontal portion 40C having a height that is about half of the height of that of the leading longitudinal face 34B and trailing longitudinal face 36B. The horizontal portion 40C can connect the valley 40B of each leg 40 together.

The legs 40 may be aligned such that they are substantially perpendicular to the contact plane. Alternatively, the legs 40 may be aligned such that they inclined slightly toward the front edge 24A and the rear edge 24B of the housing 24 of the blade unit 14. This inclination can assist in the friction fit of the skin contact member 16 to the blade unit 14.

In an embodiment of the present invention, for example, the embodiment shown in FIG. 12, when the skin contact member 16 is connected to the blade unit 14, the ears 40A contact the front edge 24A and the rear edge 24B of the housing 24 of the blade unit 14, respectively, which can assist in holding the skin contact member 16 to the blade unit 14. In a preferred embodiment of the present invention, the ears 40A do not interfere with the pivoting of the shaving blade assembly 18, which may be provided for via the connecting means 44. In addition, in an embodiment of the present invention, as further shown in FIG. 12, the valleys 40B and straight horizontal portions 40C of each leg 40 have a height less than the ears 40A.

In an embodiment of the present invention, the friction fit between the skin contact member 16 and the blade unit 14 is provided by the legs 40, ears 40A, valleys 40B, and substantially straight horizontal portions 40C. In an embodiment of the present invention, the friction fit between the skin contact member 16 and the blade unit 14 is provided by the legs 40, ears 40A, valleys 40B, substantially straight horizontal portions 40C, and the protrusions 32. In an embodiment of the present invention, the friction fit between the skin contact member 16 and the blade unit 14 is provided by the protrusions 32.

In reference to FIGS. 10-14, in order to protect the shaving blade assembly 18 (at least the blade unit 14, more precisely the blade edges 22) especially from dirt, and in order to protect the user from inadvertent cuts or inadvertent use of the blade unit 14, the shaving blade assembly 18 of an embodiment of the present invention is provided with a protective cover 46 for shielding each of the cutting edges 22.

The protective cover 46 is preferably completely detachable (see FIG. 10) from the shaving blade assembly 18 and is preferably slidable on the shaving blade assembly 18 such that it can be easily put on and released from the shaving blade assembly 18. The protective cover 46 can be provided with at least one locker 48 cooperating with a corresponding locker slot 50 shaped to receive the locker 48 and provided on the skin contact member 16 in order to hold the protective cover 46 in a full stop position on the shaving blade assembly 18 as best depicted in FIG. 13 (where the protective cover 46 covers more or less the shaving blade assembly 18). Thus, the protective cover 46 cannot be accidentally detached from the shaving blade assembly 18.

Figure 10:
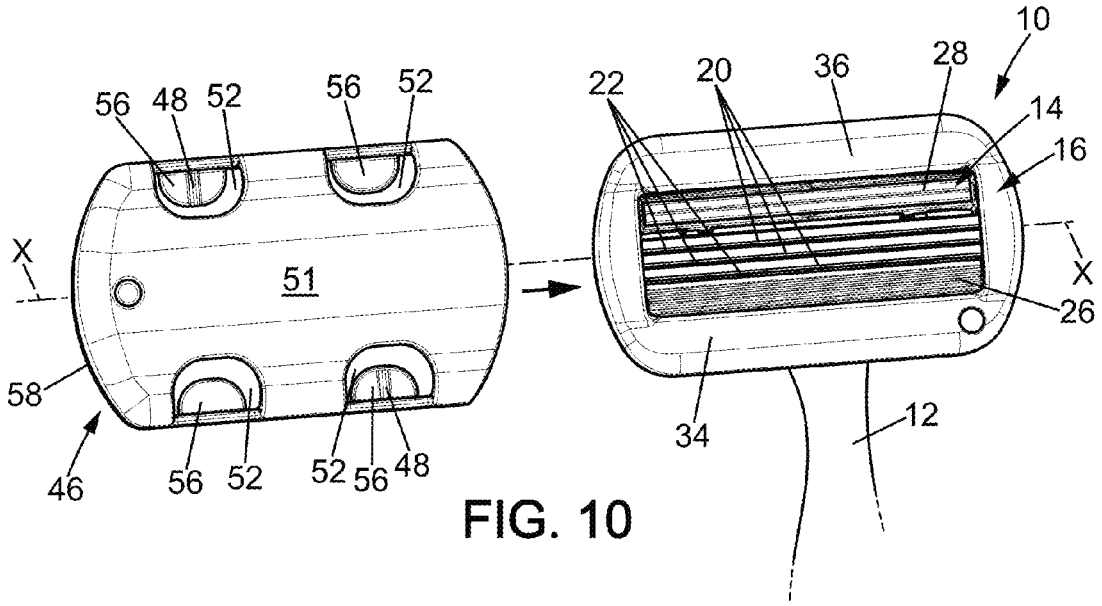
FIG. 10 is a front perspective view of a razor according to an embodiment of the present invention with a detached protective cover according to an embodiment of the present invention.
Figure 11:
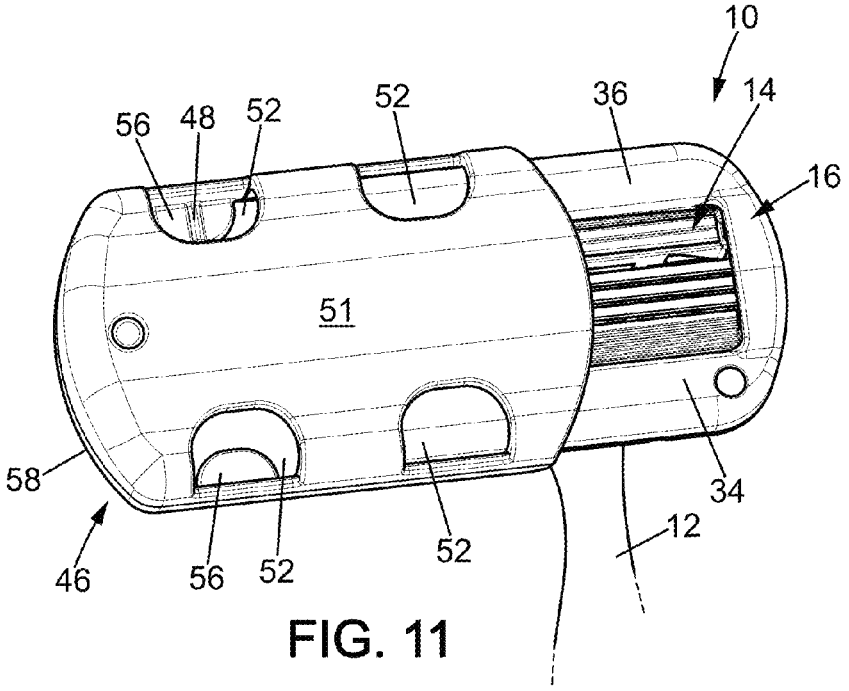
FIG. 11 is a front perspective view of the razor of FIG. 10 with the protective cover partly attached.

As best seen in FIG. 10, the protective cover 46 can, for example, be provided with at least two lockers 48 provided on the rear face of the protective cover 46 for cooperating with at least two respective locker slots 50 provided on the skin contact member 16, as best visible in FIGS. 3 and 4. An embodiment of the present invention also includes only one locker 48 and one corresponding locker slot 50.

The protective cover 46 includes an upper face 51 that can be provided with openings 52 to allow an aeration of the shaving blade assembly 18. Actually, as best visible in FIGS. 10, 11 and 13, in an embodiment of the present invention, four openings 52 are provided on the upper face 51, two of them being above the leading skin contact part 34 and two of them being above the trailing skin contact part 36 as best visible in FIG. 13 in the full stop position.

Tabs 56 are provided on the rear face of the protective cover 46. More precisely, as best visible in FIGS. 10 and 12, in an embodiment of the present invention, four tabs 56 are provided such that the protective cover 46 can encase the shaving blade assembly 18 when slid onto the same. The tabs 56 and the upper face 51 define a volume in which the shaving blade assembly 18 can be received when the protective cover 46 is slid onto the razor. The protective cover 46 can further include a bottom abutment 58 forming an abutment for the protective cover 46 when it is slid onto the shaving blade assembly 18.

The above mentioned lockers 48 can each include a rib (see FIG. 10) and can be provided on the inner surface of the tabs 56. For example, in an embodiment of the present invention, a first locker 48 is provided on one of the tabs 56 on the side of the leading skin contact part 34 and a second locker 48 is provided on one of the tabs 56 on the side of the trailing skin contact part 36. A first locker slot 50 can be provided correspondingly on the protective cover 46 on the side of the leading skin contact part 34 and a second locker slot 50 can be provided on the protective cover 46 on the side of the trailing skin contact part 36. Additionally, several lockers and lockers slots can be provided. For example, at least one locker 48 can be provided on each of the at least four tabs 56 in order to snap-fit in at least four corresponding locker slots 50 as visible in FIG. 12. Similarly, the lockers are provided on the protective cover 46 and the locker slots on the skin contact member 16, but the reverse is possible—the lockers are provided on the skin contact member 16 and the locker slots are provided on the protective cover 46, or a combination is possible (lockers and locker slots are provided on the skin contact member 16 and locker and locker slots are provided on the protective cover 46). In an embodiment of the present invention, at least one locker and one locker slot is provided on the skin contact member 16 and on the protective cover 46.

When the protective cover 46 is completely slid on the shaving blade assembly 18, it is in its full stop position and the lockers 48 are cooperating with the locker slots 50. The protective cover 46 is able to slide on the shaving blade assembly 18 until the lockers 48 snap-fit/cooperate with the locker slots 50.

In reference to FIG. 14, the connecting means 44 are still accessible when the protective cover 46 is connected onto the shaving blade assembly 18. Actually, there is no need to detach the razor handle 12 from the shaving blade assembly 18 to attach/detach the protective cover 46.

The protective cover 46 can include a material such as plastic, for example, including, but not limited to ABS, polypropylene, or the like. The protective cover 46 is preferably molded in one piece.

The embodiments of the present invention further include a razor including a razor handle and a shaving blade assembly according to any of the embodiments described herein, where the shaving blade assembly 18 is provided with a connecting means 44 for connecting the shaving blade assembly 18 to the razor handle 12. The connecting means can include shell bearings (44) or the like provided on the blade unit (14).

The embodiments of the present invention also include a method of making the blade unit 14, a method of making the skin contact member 16, and a method of making the protective cover 46. Specifically, the method of making the skin contact member 16 includes, but is not limited to, injection molding one or more thermoplastic and/or thermosetting polymer material, e.g., plastics. In an embodiment of the present invention, material for the skin contact member 16 is fed into a heated barrel, mixed, and forced into a mold cavity where it cools and hardens to the proper configuration. The molded hardened skin contact member 16 may be ejected from the mold by applying a force (e.g., via a pin ejection system) in one or more locations. The method of making the protective cover 46 includes, but is not limited to, injection molding one or more thermoplastic and/or thermosetting polymer material, e.g., plastics. In an embodiment of the present invention, material for the protective cover 46 is fed into a heated barrel, mixed, and forced into a mold cavity where it cools and hardens to the proper configuration. The molded hardened protective cover 46 may be ejected from the mold by applying a force (e.g., via a pin ejection system) in one or more locations.

I claim:

1. A shaving blade assembly comprising:

a blade unit comprising:

a housing;

at least one shaving blade having a cutting edge;

a first part of the housing in front of the cutting edge;

a second part of the housing behind the cutting edge; and a shaving plane tangent to the first part and the second part, a skin contact member comprising:

a leading skin contact member extending in front of the at least one shaving blade, the leading skin contact member having a substantially u-shaped cross section including a leading planar leg and a leading longitudinal leg, wherein the leading longitudinal leg is substantially perpendicular to the leading planar leg;

a trailing skin contact member extending rearward of the at least one shaving blade, the trailing skin contact member having a substantially u-shaped cross section including a trailing planar leg and a trailing longitudinal leg, wherein the trailing longitudinal leg is substantially perpendicular to the trailing planar leg wherein the leading skin contact member further includes a leading interior leg substantial parallel with the leading longitudinal leg, and wherein the leading interior leg deforms elastically to engage to the first part of the housing and includes a non-contiguous shape having a series of waves on an inside section of the leading interior leg to increase elasticity of the leading interior leg.

2. The shaving blade assembly according to claim 1, the u-shaped cross section of the leading skin contact member further includes a leading curved portion, the leading longitudinal leg is joined to the leading planar leg by the leading curved portion, and the leading curved portion includes a radius of curvature between about 1 mm and 3 mm.

3. The shaving blade assembly according to claim 1, the u-shaped cross section of the trailing skin contact member further includes a trailing curved portion, the trailing longitudinal leg is joined to the trailing planar leg by the trailing curved portion, and the trailing curved portion includes a radius of curvature between about 1 mm and 3 mm.

4. The shaving blade assembly according to claim 1, the engagement between the leading interior leg and the first part of the housing is a friction fit.

5. The shaving blade assembly according to claim 1, wherein the u-shaped cross section of the trailing skin contact member further includes a trailing interior leg substantially parallel with the trailing longitudinal leg.

6. The shaving blade assembly according to claim 5, wherein the trailing interior leg is disposed adjacent to the second part of the housing.

7. The shaving blade assembly according to claim 5, wherein the trailing interior leg provides a friction fit to the second part of the housing.

8. The shaving blade assembly according to claim 5, wherein the trailing interior leg deforms elastically to attach the skin contact member to the blade unit and includes a non-contiguous shape having a series of waves on an inside section of the trailing interior leg to increase elasticity of the trailing interior leg.

9. The shaving blade assembly according to claim 1, wherein the leading planar leg includes a leading planar surface and the trailing planar leg includes a trailing planar surface, the leading planar surface and the trailing planar surface defining a contact plane, wherein the contact plane and the shaving plane are parallel, wherein the contact plane is above the shaving plane, and wherein a distance between the contact plane and the shaving plane is between about 0.2 mm to 0.6 mm.

10. The shaving blade assembly according to claim 1, wherein the blade unit has a blade unit skin contact surface area, the blade unit and the skin contact member have a shaving blade assembly skin contact surface area, wherein a ratio between the shaving blade assembly skin contact surface area and the blade unit skin contact surface area is between approximately 2 and 3.1.

11. The shaving blade assembly according to claim 1, wherein the blade unit further comprises a guard and a cap, and wherein the skin contact member completely surrounds the blade unit.

12. The shaving blade assembly according to claim 1, wherein the skin contact member comprises a material chosen among plastics, metals, and/or lacquered wood addition, and wherein the skin contact member has a friction coefficient between approximately 0.3 and 0.7 when it comprises the plastic, a friction coefficient between approximately 1.05 and 1.35 when it comprises the metal, or a friction coefficient between approximately 0.25 and 0.5 when it comprises the lacquered wood.

13. The shaving blade assembly according to claim 1, further comprising thermochromic pigments disposed in the skin contact member capable of conveying information to a user, the information including pigments that change a color of the skin contact member to blue when it is too cold, to red when it is too hot, or to pink when the skin contact member is ready for use.

14. A shaving blade assembly comprising:

a blade unit comprising:

a housing;

at least one shaving blade having a cutting edge;

a first part of the housing in front of the cutting edge;

a second part of the housing behind the cutting edge; and a shaving plane tangent to the first part and the second part, a skin contact member comprising:

a leading skin contact member extending in front of the at least one shaving blade, the leading skin contact member having a substantially u-shaped cross section including a leading planar leg, a leading longitudinal leg, a leading interior leg, and a leading curved portion, wherein the leading longitudinal leg is substantially perpendicular to the leading planar leg;

wherein the leading longitudinal leg is joined to the leading planar leg by the leading curved portion, a trailing skin contact member extending rearward of the at least one shaving blade, the trailing skin contact member having a substantially u-shaped cross section including a trailing curved portion, a trailing longitudinal leg, and a trailing curved leg, wherein the trailing longitudinal leg is substantially perpendicular to the trailing planar leg, wherein the trailing longitudinal leg is joined to the trailing planar leg by the trailing curved portion; and wherein the leading interior leg is substantially parallel with the leading longitudinal leg, wherein the leading interior leg is disposed adjacent to the first part of the housing, wherein the leading interior leg deforms elastically to provide a friction fit with the first part of the housing, and wherein the leading interior leg includes a non-contiguous shape having a series of waves on an inside section of the leading interior leg to increase elasticity of the leading interior leg.

15. The shaving blade assembly according to claim 14, the leading curved portion includes a radius of curvature between about 1 mm and 3 mm and wherein the trailing curved portion includes a radius of curvature between about 1 mm and 3 mm.

16. A shaving blade assembly comprising:

a blade unit comprising:

a housing;

at least one shaving blade having a cutting edge;

a first part of the housing in front of the cutting edge;

a second part of the housing behind the cutting edge; and a shaving plane tangent to the first part and the second part, a skin contact member comprising:

a leading skin contact member extending in front of the at least one shaving blade, the leading skin contact member having a substantially u-shaped cross section including a leading planar leg, a leading longitudinal leg, a leading interior leg, and the leading curved portion, wherein the leading longitudinal leg is substantially perpendicular to the leading planar leg, wherein the leading longitudinal leg is joined to the leading planar leg by the leading curved portion, and wherein the leading interior leg is substantially parallel with the leading longitudinal leg, wherein the leading interior leg deforms elastically to engage to the first part of the housing and includes a non-contiguous shape having a series of waves on an inside section of the leading interior leg to increase elasticity of the leading interior leg;

a trailing skin contact member extending rearward of the at least one shaving blade, the trailing skin contact member having a substantially u-shaped cross section including a trailing planar leg, a trailing longitudinal leg, a trailing interior leg, and a trailing curved portion, wherein the trailing longitudinal leg is substantially perpendicular to the trailing planar leg, wherein the trailing longitudinal leg is joined to the trailing planar leg by the trailing curved portion, and wherein the trailing interior leg is substantially parallel with the trailing longitudinal leg.

* * * * *